United States Patent [19]

Roberts

[11] 4,072,295

[45] Feb. 7, 1978

[54] FOLDABLE BACKSTOP AND LIKE STRUCTURE

[76] Inventor: Darrel V. Roberts, 13455 Fort St., Draper, Utah 84020

[21] Appl. No.: 662,543

[22] Filed: Mar. 1, 1976

[51] Int. Cl.[2] ..... E04H 17/16

[52] U.S. Cl. ..... 256/26; 273/26 A

[58] Field of Search ..... 256/26, 65; 273/26 A; 182/152

[56] References Cited

U.S. PATENT DOCUMENTS

| | | | |
|---|---|---|---|
| 2,292,109 | 4/1942 | Engel | 273/26 A |
| 2,819,901 | 1/1958 | Mateja | 273/26 A |
| 2,827,295 | 3/1958 | Austin | 273/26 A |
| 3,011,586 | 12/1961 | Harvey, Jr. | 182/179 |
| 3,204,606 | 9/1965 | Parr et al. | 256/26 |
| 3,408,071 | 10/1968 | Lundy | 273/26 A |

*Primary Examiner*—Werner H. Schroeder

*Assistant Examiner*—Doris L. Troutman

*Attorney, Agent, or Firm*—Mallinckrodt & Mallinckrodt

[57] ABSTRACT

A baseball backstop or similar structure, such as dog run, fence section, etc., is constructed of panel sections uniquely connected together so the entire structure is foldable for shipment to the erection site. The panel sections are each made up of steel tubing, forming a frame, and of steel chain link fence fabric covering the frame. Adjoining frames are hingedly connected by sleeves of larger diameter steel tubing rigidly secured to the frame of one of the adjoining panel sections, as by welding, and closely but freely encircling a frame member of the other of the adjoining panel section. The chain link fence fabric of the one panel section is secured at one of its sides to the frame of that section and at its opposite side to the said frame member of the other section. Set screws in the sleeves provide rigidity for the structure after erection.

5 Claims, 7 Drawing Figures

FIG. 4
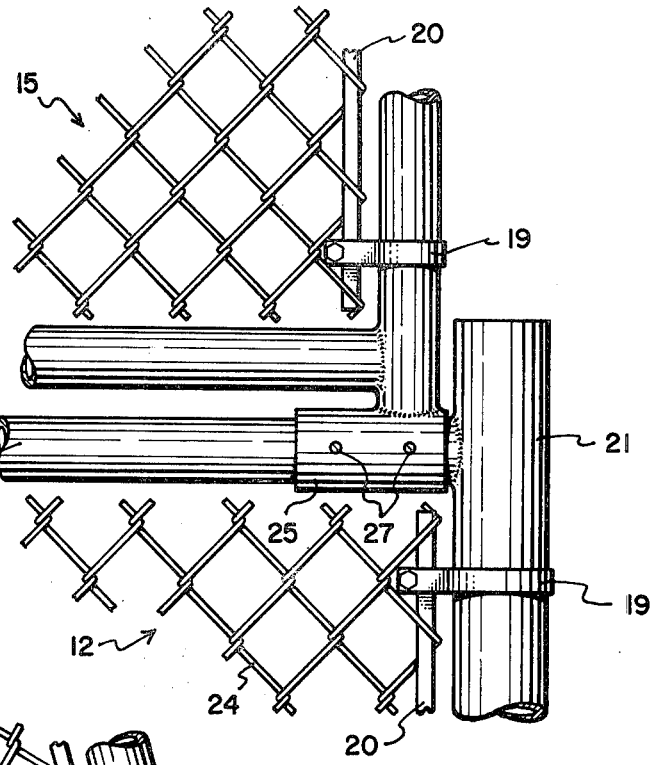
FIG. 5
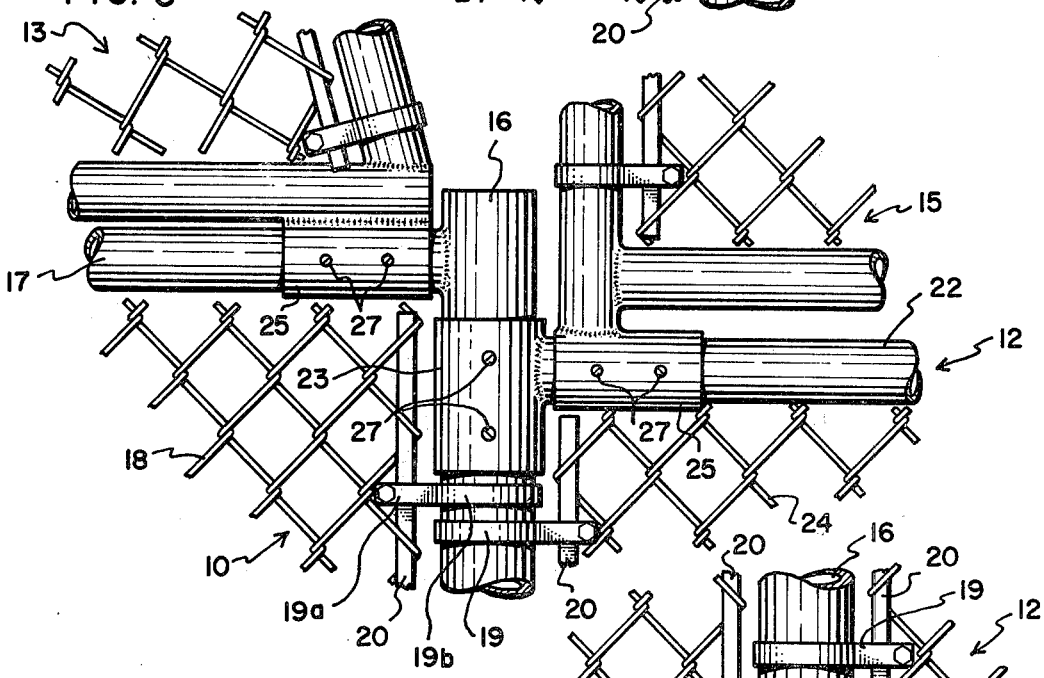
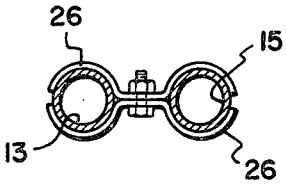
FIG. 7
FIG. 6

FOLDABLE BACKSTOP AND LIKE STRUCTURE

BACKGROUND OF THE INVENTION

1. Field

The invention is in the field of baseball backstops and the like constructed of chain link fencing materials.

2. State of the Art

Baseball backstops are ordinarily constructed at the erection site from materials delivered to the site. Chain link fencing materials are commonly employed for the purpose, but require considerable labor to assemble at the erection site. Heretofore, there has been no successful way known for economically factory fabricating a backstop that can be folded, without structural damage, for convenient transport by truck or other carrier.

SUMMARY OF THE INVENTION

In accordance with the invention, a baseball backstop or similar structure is factory fabricated from the usual chain link fencing materials, namely, steel tubing, chain link fence fabric of heavy steel wire, and fabric-attachment collars, by a unique hinging arrangement of adjoining panel sections. Hinges in the form of relatively short sleeves of steel tubing are rigidly secured in mutually spaced relationship, as by welding, to respective transverse frame members of one of mutually adjoining panel sections. The sleeves encircle an adjoining post frame member of the other of the mutually adjoining panel sections. The usual attachment collars employed in chain link fencing are utilized to attach one side of the chain link fabric covering of the one section to a post frame member of that one section and the other side of such chain link fabric covering to the post frame member of the other section that is encircled by the hinging sleeves. Such covering is stretched taut between the two post frame members to which they are attached.

Although attempts were made by me initially to utilize similar attachment collars for hinging purpose between panel sections, such attempts were unsuccessful. It was found that the stretching of the chain link fabric imposed so much misaligning stress on the two post frame members to which it was attached that the hinging collars would break when the panel sections were folded together.

THE DRAWINGS

In the drawings, which illustrate a baseball backstop embodying the best mode presently contemplated or carrying out the invention in actual practice:

Figure 2:
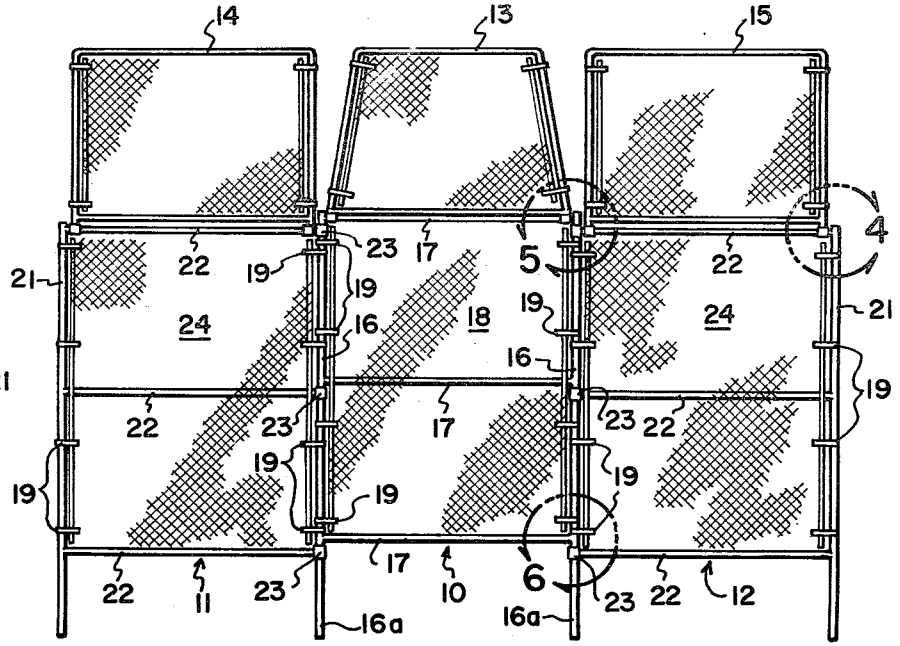
FIG. 2, is a front elevation of the backstop standing in erect and extended position following factory fabrication, but before folding.
Figure 3:
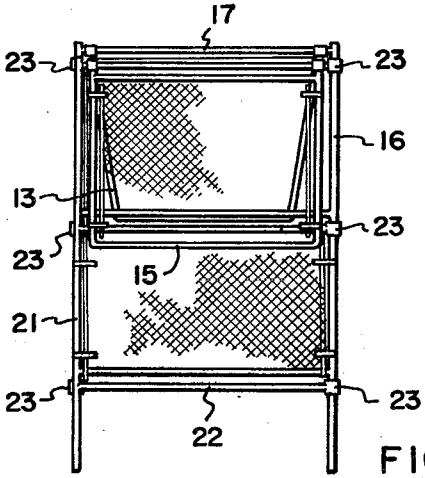
Figure 1:
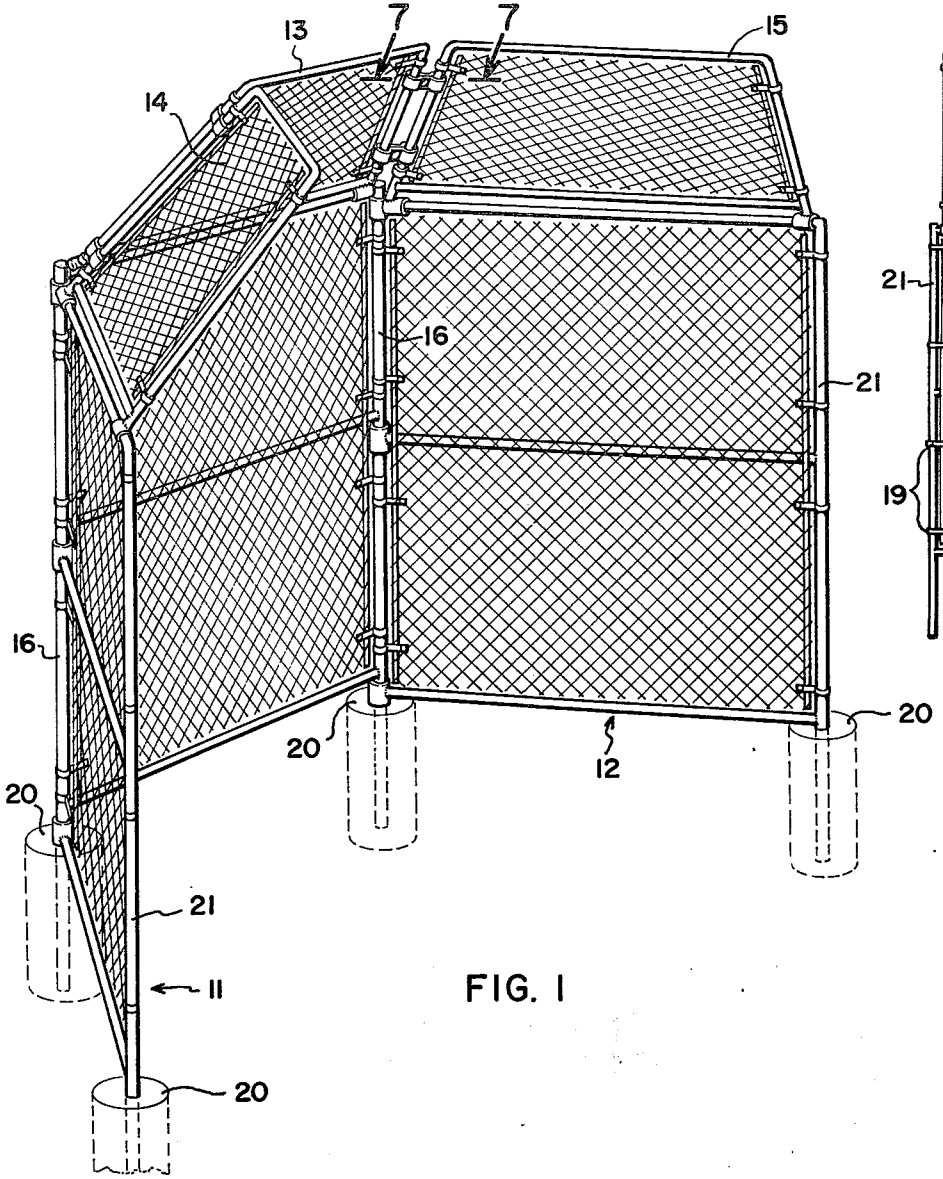
FIG. 1 is a pictorial view, looking from one side and toward the front, of a baseball backstop of the invention as erected in the field following factory fabrication and transport to the erection site in folded condition.

FIG. 3, a similar view after folding for transport;

FIG. 4, a fragmentary, enlarged view of that portion of FIG. 2 encircled by the line of FIG. 2;

FIG. 5, a similar view of that portion of FIG. 2 encircled by the line 5 of FIG. 2;

FIG. 6, a similar view of that portion of FIG. 2 encircled by the line 6 of FIG. 2; and FIG. 7, a fragmentary horizontal section taken along the line 7—7 of FIG. 1 to show how the overhead and overhanging panel sections of the backstop are secured in overhanging positions.

DETAILED DESCRIPTION OF THE ILLUSTRATED EMBODIMENT

In its illustrated form, the structure of the invention is a baseball backstop having a central panel section 10 and a pair of flanking panel sections 11 and 12, with corresponding overhead panel sections 13, 14, and 15, respectively, canted forwardly in the erected condition of the backstop to overhang the interior of the structure, as shown in FIG. 1.

Each of the panel sections is fabricated from chain link fencing materials and comprises a frame of heavy steel tubing, with chain link fence fabric covering the frame and stretched taut. Conventional attachment collars secure the stretched fabric to the frame members, and conventional clamps secure the overhead panel sections in their overhanging positions.

Central panel section 10 comprises post frame members 16 at opposite lateral sides thereof and transverse frame members 17 at top and bottom and intermediate the height of the frame. The transverse members are rigidly secured to the post members, preferably by welding, to provide a strong and rigid frame structure. Chain link fence fabric 18 is stretched taut over the frame and secured in the usual manner by conventional attachment collars 19, whose ends **19*a* are securely clamped over attachment strips 20, FIGS. 5 and 6, that are inserted in closed links marginal to the fabric, and whose loop portions 19*b* freely encircle adjacent post frame members 16. Leg portions 16*a* of post frame members 16 are left free for encasement in concrete footings 20, FIG. 1**, cast into holes dug in the ground.

Each of the flanking panel sections 11 and 12 comprises a post frame member 21 at the outer lateral side of the frame and transverse frame members 22 at top and bottom and intermediate the height of the frame and rigidly secured to post frame member 21, preferably by welding. There is no post frame member at the inner lateral side of the frame. Instead, relatively short sleeves 23, FIGS. 5 and 6, of steel tubing are secured, preferably by welding, to the ends of respective transverse frame members 22 and freely encircle the adjoining post frame member 16 of central panel section 10 as hinge members.

Chain link fence fabric 24 is applied to the frame members of flanking panel sections 11 and 12, as in the instance of central panel section 10, by means of attachment strips 20 and attachment collars 19. Here, however, anchorage and taut stretching of such fabric is between the one post frame member 21 of a flanking panel section and the corresponding post frame member 16 of center panel section 10.

It should be noted that this is an economical and highly desirable arrangement from the standpoint of fabrication and minimizing of weight, but that it imposes severe stresses and strains on the hinging means. We have found that hinge sleeves of the same steel tubing as the frame members, but of appropriate diameter to encircle a frame member serving as a hinge pintle, will accommodate to misalignments caused by stretching of the fabric covering and will resist stresses and strains during folding and unfolding of the panel sections relative to one another.

Overhead panel sections 13, 14, and 15 are of usual shapes to fit together as an overhanging canopy in the erected condition of the structure. They are each independently fabricated of steel tubing, steel chain-link-fence fabric, and attachment strips and collars, as is central panel section 10, and are hingedly attached to the top transverse frame members of their corresponding center and flanking panel sections, respectively, by relatively short sleeves 25 of steel tubing. In their forwardly canted and overhanging, erected positions, they are secured together by clamps 26, FIG. 7.

The structure is factory fabricated as in FIG. 2, and, as shown in FIG. 3, it can be compactly folded for transport to the erection site, where it is unfolded for erection. Means, such as set screws 27, are provided for preventing hinging action of the hinges following erection of the structure.

Other backstop structures, e. g. for basketball, and structures other than backstops, for example, dog runs, sections of fencing, etc. may be constructed in similar manner, with or without overhead panel sections, depending upon the use to be made of the structures.

Whereas this invenion is here illustrated and described with respect to an embodiment representing the best mode presently contemplated for carrying out the invention in practice, it should be understood that various changes may be made without departing from the inventive concepts particularly pointed out in the claims which follow.

I claim:

1. A factory-fabricated baseball backstop or like structure constructed to fold compactly for transportation to an erection site, comprising a plurality of side-by-side, laterally adjoining and hinged panel sections, each having a frame made up of steel tubing as upstanding post and transverse frame members, and having steel chain link fence fabric covering the frame; hinges in the form of relatively short sleeves of steel tubing rigidly secured in mutually spaced relationship to respective transverse frame members of one of mutually adjoining sections and freely encircling a post frame member of the other said mutually adjoining sections as a hinge sleeve, said post constituting the hinge pintle; means attaching one side of the chain link fence fabric of said one section to a post frame member of that section; means attaching the other side of the chain link fence fabric of said one section to the hinge-sleeve-encircled, post frame member of said other of the mutually adjoining sections, the chain link fence fabric of said one section being stretched taut between the post frame members to which it is attached; and means for preventing hinging action of the hinges following erection of the structure, whereby, in the erected structure, adjoining panel sections have a single post in common which is a part of only one of said adjoining panel sections, mutually adjacent lateral margins of the fence fabric of the respective adjoining panel sections being attached to the common post under stretching stress.

2. A backstop or the like according to claim 1, wherein the relatively short, hinge sleeves of steel tubing are rigidly secured to the respective transverse frame members by respective welds.

3. A backstop or the like according to claim 1, wherein the plurality of panel sections comprise a central panel section flanked on opposite sides thereof by adjoining and hinged panel sections; the central panel section having a post frame member at each of its lateral sides, and each of the flanking panel sections having a post frame member only at the lateral side thereof that is remote from the central panel section; each of said adjoining and hinged panel sections being hinged to said central panel section as the one panel section of claim 1 is hinged to the other panel section of claim 1, and having its chain link fence fabric secured and stretched taut between it and said central panel section as the chain link fence fabric of the one panel section of claim 1 is secured and stretched taut between it and the other panel section of claim 1.

4. A backstop or the like according to claim 3, wherein overhead and overhanging panel sections are hinged to the upper ends of the central panel section and the flanking panel sections, respectively; and wherein clamping means are provided to secure said overhead panel sections in overhanging positions when the structure is unfolded and erected.

5. A backstop or the like according to claim 1, wherein the means for preventing hinging action are set screws threaded in the hinge sleeves.

* * * * *